US006214752B1

(12) United States Patent
Sakuma

(10) Patent No.: US 6,214,752 B1
(45) Date of Patent: Apr. 10, 2001

(54) SHOE PRESS JACKET

(75) Inventor: Norio Sakuma, Tanashi (JP)

(73) Assignee: Ichikawa Co., Ltd., Tokyo (JP)

( * ) Notice: Subject to any disclaimer, the term of this patent is extended or adjusted under 35 U.S.C. 154(b) by 0 days.

(21) Appl. No.: 09/175,555

(22) Filed: Oct. 20, 1998

(30) Foreign Application Priority Data

Oct. 20, 1997 (JP) ..... 9-306575

(51) Int. Cl.[7] ..... D03D 13/00; D21F 3/00

(52) U.S. Cl. ..... 442/59; 162/358.4; 162/901; 427/358; 442/189

(58) Field of Search ..... 442/59, 189; 427/358; 162/358.4, 901

(56) References Cited

U.S. PATENT DOCUMENTS 4,946,731 * 8/1990 Dutt ..... 428/156

5,772,848 * 6/1998 Dutt ..... 162/358.4

FOREIGN PATENT DOCUMENTS 63-15398 4/1988 (JP) .

3-57236 8/1991 (JP) .

* cited by examiner

*Primary Examiner*—Blaine Copenheaver

(74) *Attorney, Agent, or Firm*—Pearne & Gordon LLP

(57) ABSTRACT

A shoe press jacket, wherein a base fabric layer consisting of woven cloth having filament yarn of straight or nearly straight arrangement in at least one of warp and weft is coated with resin from one surface thereof, the thickness of said base fabric layer is filled with said resin and a coated layer is formed on the opposite surface.

4 Claims, 2 Drawing Sheets

SHOE PRESS JACKET

BACKGROUND OF THE INVENTION

The present invention relates to a shoe press jacket with minimal surface abrasion and dimensional change.

A general shoe press is composed, as shown in FIG. 4, of a top roll 12, a top felt 13, a wet web 14, a bottom felt 13', a jacket 11 and a shoe 15 so that the top felt 13, the wet web 14, the bottom felt 13' and the jacket 11 are rotated together with the top roll 12 as the driving source.

As shown in FIG. 3, the jacket 11 is composed of a fabric 1' coated with a resin 6'. In most conventional jackets 11, in order to prevent abrasion due to friction between the jacket 11 and the shoe 15, only the side 11*a* of the fabric 1' in contact with the shoe is coated with resin, and the surface side 11*b'* is exposed.

However, the jacket 11 has a short life because the surface side 11*b'* wears due to slippage between the jacket 11 and the back of the bottom felt 13' as the jacket 11 rotates in contact with the back of the bottom felt 13'. The jacket 11 also frays due to abrasion.

As a countermeasure against the wear and abrasion of the jacket 11 on the surface side 11*b'*, a jacket 11 of a type in which the surface side 11*a* is also coated with resin has also been developed. Examples of this type jacket are shown in Japanese Patent Publication Nos. 57236/1991 and 15398/1988.

However, the jackets of Japanese Patent Publication Nos. 57236/1991 and 15398/1988 tend to have large deformations in the MD (machine direct) and CD (cross machine direct) directions. This is partly because the fixing force of the base fabric layer due to the resin is inferior owing to the thin resin layer on the surface side, and partly because the resin on the surface side is cracked because of dimensional change in the base fabric layer and the surface abrasion causes moisture from the surface side to percolate through the interior causing swelling.

If this type jacket is used in a closed type shoe press, a situation develops that compels the machine to be stopped during use for repairs such as width trimming or replacing the jacket.

SUMMARY OF THE INVENTION

The present invention minimizes the above-described defects, and its object is to provide a shoe press jacket capable of reducing dimensional change in the MD (machine direct) and CD (cross machine direct) directions and surface abrasion during use.

In order to achieve the above-described objects, a shoe press jacket according to the present invention is constituted by coating a base fabric layer consisting of woven cloth having filament yarn of straight or nearly straight arrangement in at least one of warp and weft with resin from one surface thereof, filling the thickness of the base fabric layer with the resin and forming a coated layer on the opposite surface thereof so that dimensional stability in the MD and CD directions is given by filament yarn of straight or nearly straight arrangement and that resin layers, with which one surface and the opposite surface of the base fabric layer are coated, and the base fabric layer which is filled with resin, are made integral with each other to make it difficult to separate them for reliably preventing surface abrasion during use.

As regards the filament yarn of straight or nearly straight arrangement, in the case of the base fabric layer being double warp or triple warp, when the filament yarn is inserted in the weft direction, the crosswise modulus increases, and change in width at the time of heat setting and tentering in use decreases, resulting in a construction difficult to extend in the width direction. Also, in the case of the base fabric layer being double weft or triple weft, when the filament yarn is inserted in the warp direction, the lengthwise modulus increases, and change in the length direction at the time of heat setting and the change in tension during resin treatment decrease, resulting in a construction having high strength omnidirectionally capable of manufacturing stable products.

Additionally, the invention may be characterized in that the same yarn as the ground yarn or dimensionally-stable yarn is used for the filament yarn of straight or nearly straight arrangement. If the material for the ground yarn is dimensionally-stable yarn, the same dimensionally-stable yarn as the ground yarn can be used as the straight or nearly straight component, and if the ground yarn is not dimensionally-stable yarn, a dimensionally-stable yarn can be used as the straight or nearly straight component. Namely, the base fabric layer is constituted so that the dimensional change in the MD and CD directions during use can always be reduced irrespective of the material for the ground yarn.

DESCRIPTION OF THE PREFERRED EMBODIMENTS

Figure 1:
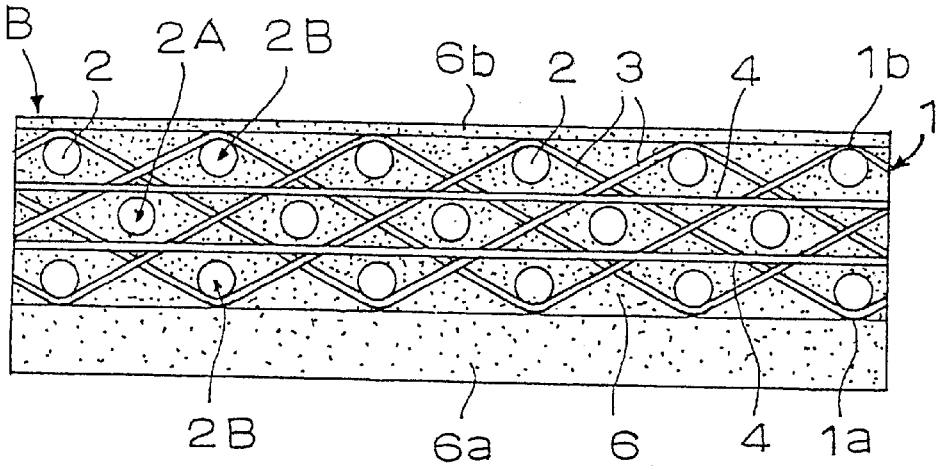
FIG. 1 is a schematic cross-sectional view along the CD direction, showing a jacket according to the invention.
Figure 2:
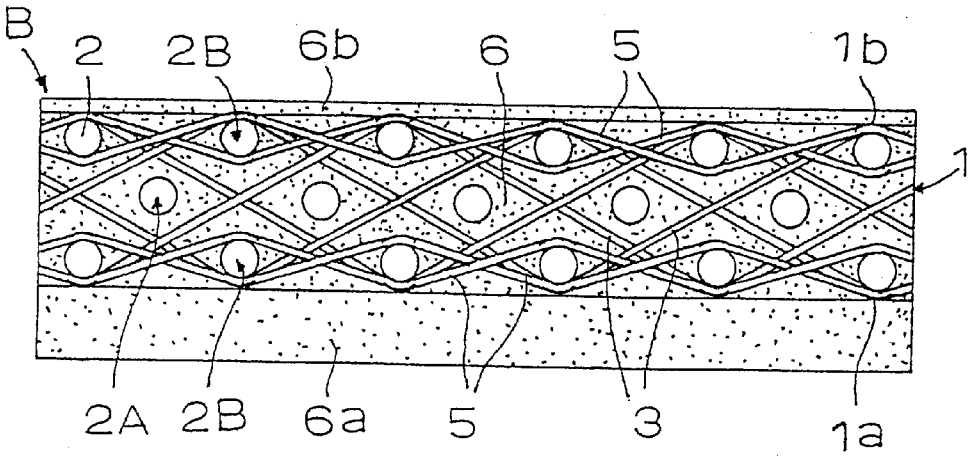
FIG. 2 is a schematic cross-sectional view along the CD direction, showing another embodiment of a jacket according to the invention.

Referring to FIGS. 1 and 2, the jacket B includes the base fabric layer 1 and the resin 6. The base fabric layer 1 includes woven cloth having straight filament yarn 4 or filament yarn 5 of nearly straight arrangement in at least one of warp 2 and weft 3.

The base fabric layer 1 is coated (coated layer 6*a*) with the resin 6 from one surface 1*a*, and the thickness of the base fabric layer 1 is filled with the resin 6 to form a coated layer 6*b* on the opposite surface 1*b* of the base fabric layer 1. The coated layers 6*a* and 6*b* which cover one surface 1*a* of this base fabric layer 1 and the opposite surface 1*b*, respectively, are made completely integral with the resin 6 filled within the thickness of the base fabric layer 1.

For the fabric cloth constituting the base fabric layer 1, a bulky one such as, for example, double warp or triple warp woven fabric and double weft or triple weft woven fabric can be satisfactorily used. Of course, the base fabric texture is not limited to the foregoing.

The filament yarn 4 of the straight arrangement has, as shown in FIG. 1, been inserted along the weaving direction of weft 3 without rising and falling so as to sandwich the upper and lower sides of intermediate warp 2A of the base fabric layer 1 therebetween. Also, the filament yarn 5 of the nearly straight arrangement is, as shown in FIG. 2, inserted in such a manner to alternately go above and below surface layer warp 2B in the base fabric layer 1 along the weaving direction of weft 3 while rising and falling by the thickness of the warp.

The filament yarn 4, 5 of straight or nearly straight arrangement is not limited to the above-described inserted state, but if the inserting direction is determined depending on the texture and structure of the base fabric layer 1, it will be possible to reduce the dimensional change omnidirectionally. This is because, for example, in the case of the woven cloth of the base fabric layer 1 being double or triple warp, when inserted along the weft direction for reinforcement in that direction, the crosswise modulus increases, and change in width at the time of heat setting decreases, while in the case of the base fabric layer 1 being double or triple weft, when inserted along the warp direction for reinforcement in that direction, the length-wise modulus increases, and change in the length direction at the time of heat setting decreases.

If the ground yarn (warp 2 and weft 3) of the woven cloth constituting the base fabric layer 1 is, for example, PET (polyethylene terephthalate) monofilament or PET multifilament, the same yarn as this may be used for the filament yarn 4, 5 of the straight or nearly straight arrangement, because the ground yarn itself has dimensional stability. Also, if comparatively easily stretchable yarn such as nylon is used for the ground yarn, dimensionally-stable yarn such as, for example, PET mono-filament will be used for the filament yarn.

FIRST EMBODIMENT

A base fabric layer 1 with a thickness of 2.0 mm including filament yarn 4 straight inserted along the weaving direction of weft 3 in a triple warp woven fabric as shown in FIG. 1 is used. The base fabric layer 1 is coated with resin 6 from one surface la (the back side) of the base fabric layer 1, on the back side of which, a coated layer 6*a* is formed to have a thickness of 1.3 mm. The thickness of the base fabric layer 1 is filled with the resin 6 and a coated layer 6*b* is formed on the opposite surface (surface side) to have a thickness of 0.2 mm. A jacket B having a total thickness of 3.5 mm is obtained.

SECOND EMBODIMENT

Next, a base fabric layer 1 with a thickness of 2.0 mm comprising filament yarn 4 inserted in a nearly-straight state (rising and falling by the thickness of the warp) along the weaving direction of weft 3 in a triple warp woven fabric as shown in FIG. 2 is used. The base fabric layer 1 is coated with resin 6 from one surface 1*a* (the back side) of the base fabric layer 1, on the back side of which, a coated layer 6*a* is formed to have a thickness of 1.3 mm. The thickness of the base fabric layer 1 is filled with the resin 6 and a coated layer 6*b* is formed on the opposite surface (surface side) to have a thickness of 0.2 mm. A jacket B having a total thickness of 3.5 mm is obtained.

FIRST COMPARATIVE EXAMPLE

Figure 3:
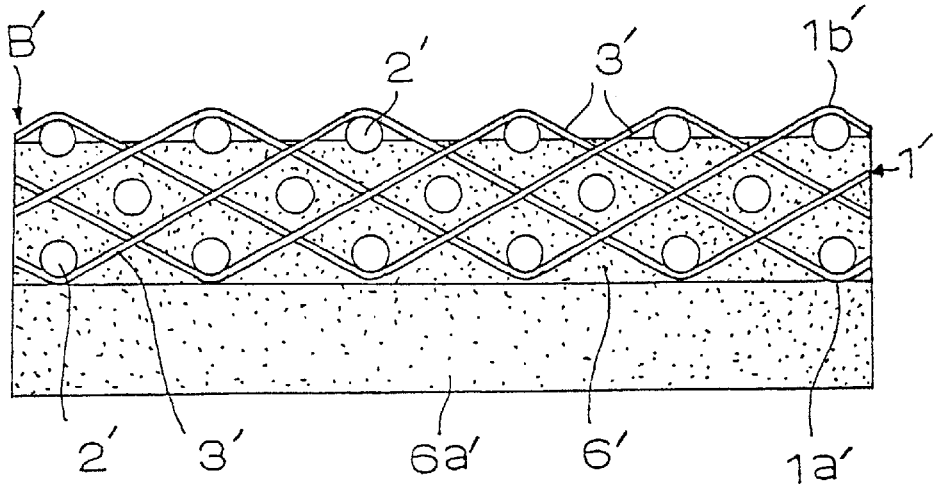
FIG. 3 PRIOR ART
FIG. 3 is a schematic cross-sectional view along the CD direction, showing an example of a conventional, typical jacket.
Figure 4:
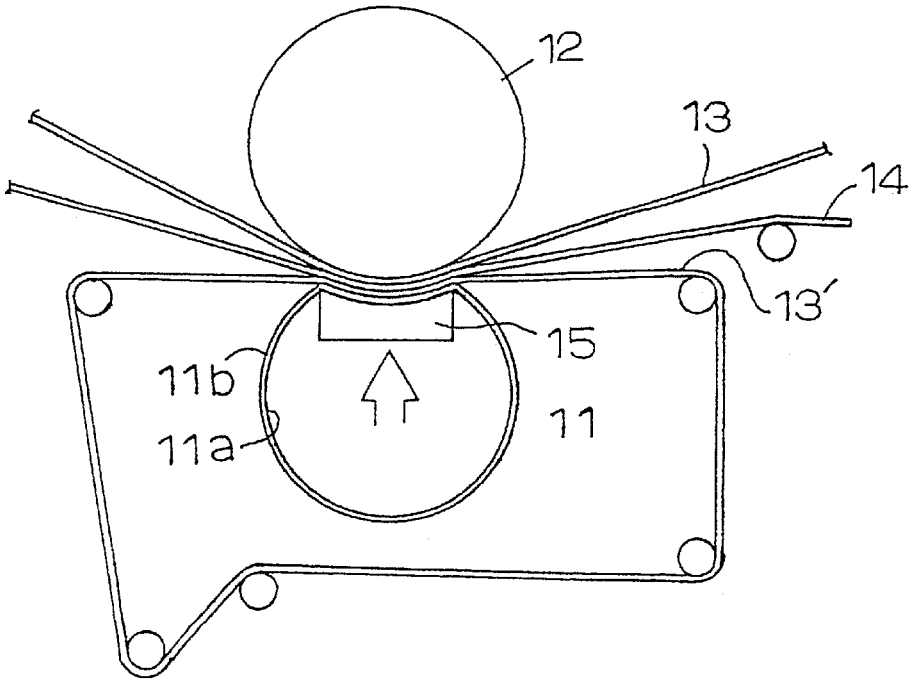
FIG. 4 PRIOR ART
FIG. 4 is an explanatory view schematically illustrating the principle of a general shoe press.

Also, a base fabric layer 1' with a thickness of 2.0 mm comprising a triple warp woven fabric as shown in FIG. 3 is used. The base fabric layer 1' is coated with resin 6' from one surface 1*a*' (the back side) of the base fabric layer 1', on the back of which a resin layer 6*a*' is formed to have a thickness of 1.5 mm. The resin 6' is caused to percolate through the thickness of the base fabric layer 1' up to an intermediate position (about ⅓), and a part of warp 2' and weft 3', which constitute the surface side of the base fabric layer 1', is caused to be exposed. A comparative jacket B' having a total thickness of 3.5 mm is obtained.

Jackets B according to these first and second embodiments of the present invention and a comparative jacket B' of the first comparative example were prepared to have a perimeter of 4.0 m and a width of 3.0 m, and applied to a shoe press machine for traveling abrasion tests.

These tests were made at a speed of 1,500 m/min and at a nip pressure of 1,300 kg/cm as the traveling conditions, and when the residual tenacity was measured after the tests, the effects shown in Tables 1 and 2 could be confirmed. Table 1 and Table 2 show the results in the MD (machine direct) direction and in the CD (cross machine direct) direction respectively. In this respect, the limited number of times for nip passage was 14,000,000 times in the first embodiment, 12,000,000 times in the second embodiment, and 5,000,000 times in the first comparative example.

TABLE 1

(MD Direction)

| | Embodiment 1 | Embodiment 2 | Comparative 1 |
|---|---|---|---|
| Before-test breaking tenacity (kg/cm) | 220 | 220 | 220 |
| Before-test modulus at 1% (kg/cm) | 25 | 25 | 25 |
| After-test breaking tenacity(kg/cm) | 176 | 176 | 110 |
| After-test modulus at 1% (kg/cm) | 19 | 19 | 11 |
| After-test length elongation (%) | 0.1 | 0.1 | 0.3 |

TABLE 2

(CD Direction)

| | Embodiment 1 | Embodiment 2 | Comparative 1 |
|---|---|---|---|
| Before-test breaking tenacity (kg/cm) | 160 | 160 | 160 |
| Before-test modulus at 1% (kg/cm) | 12 | 9 | 6 |
| After-test breaking tenacity(kg/cm) | 90 | 90 | 60 |
| After-test modulus at 1% (kg/cm) | 8 | 6 | 3 |
| After-test length elongation (%) | 0.3 | 0.6 | 1.6 |

The comparative jacket B' of the first comparative example was worn by the contact with the back of the bottom felt 13', and the upper portion of the yarn constituting it was recognized to have been frayed here and there. The tenacity in both the MD and CD directions was significantly deteriorated, and in the CD direction, the elongation allowance in the width direction was exceeded, thus resulting in preventing travel after 5,000,000 passages.

In the jacket B of the first embodiment, yarn fraying occurred after 14,000,000 passages, but a remaining allowance was left in the width stretch allowance in the CD direction, and improved crosswise modulus was an evident effect of the coated film of the base fabric layer on the surface side.

In the jacket B of the second embodiment, it was still within the usable range in view of surface abrasion after 12,000,000 passages, but the allowance for width stretch was exhausted and travel prevented. However, the effects of the countermeasure against surface abrasion and the tentering countermeasure were recognized.

In this respect, the coated layer 6*a* of the base fabric layer 1 on the back side in the first and second embodiments has a thickness of 0.2 mm, and the thickness of the coated layer 6*a* can be increased or decreased at the user's request.

As described above, a shoe press jacket according to the present invention is characterized in that a base fabric layer comprising woven cloth having filament yarn of straight or nearly straight arrangement in at least one of warp and weft is coated with resin from one surface thereof, the thickness of the base fabric layer is filled with the resin and a coated layer is formed on the opposite surface thereof. Therefore, this leads to the effects that dimensional stability in the MD and CD directions is given by filament yarn of straight or nearly straight arrangement, and that resin layers, with which one surface and the opposite surface of the base fabric layer are covered, and the resin, with which the basic fabric layer is filled, are made integral with each other to thereby make it difficult to separate them for reliably preventing the surface abrasion during the use.

Also, since the invention can be further characterized in that the same yarn as the ground yarn or dimensionally-stable yarn is used for the filament yarn of straight or nearly straight arrangement, if the material for the ground yarn is dimensionally-stable yarn, the same dimensionally-stable yarn as the ground yarn can be used as the straight or nearly straight component, and if the ground yarn is not dimensionally-stable yarn, dimensionally-stable yarn can be used for the straight or nearly straight component. Therefore, the base fabric layer has the effect that the dimensional change in the MD and CD directions during use can always be reduced irrespective of the material for the ground yarn.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed:

1. A shoe press jacket, wherein a base fabric layer comprising a woven cloth having interwoven ground yarn and filament yarn of straight arrangement in both warp and weft is coated with resin from one surface thereof, the thickness of said base fabric layer is filled with said resin and a coated layer is formed on the opposite surface.

2. A shoe press jacket as defined in claim 1, wherein said filament yarn of straight is the same type yarn as said ground yarn or is a dimensionally-stable yarn.

3. A method of making a shoe press jacket, said method comprising:

weaving a cloth having a filament yarn of straight arrangement in both warp and weft;

coating said cloth with resin from one surface of said cloth to fill said cloth with said resin and to provide a resin coating on the opposite surface of said cloth; and configuring the coated cloth as a shoe press jacket.

4. A method as defined in claim 3, wherein said weaving includes weaving a dimensionally-stable yarn as both said filament yarn and as a ground yarn for said woven cloth.

* * * * *

UNITED STATES PATENT AND TRADEMARK OFFICE

CERTIFICATE OF CORRECTION

PATENT NO. : 6,214,752
DATED : April 10, 2001
INVENTOR(S) : Norio Sakuma

It is certified that error appears in the above-identified patent and that said Letters Patent is hereby corrected as shown below:

Title page,
Item [75] delete "Tanashi" and insert therefore -- Tokyo --.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*